US010847127B2

(12) United States Patent
Stringham et al.

(10) Patent No.: US 10,847,127 B2
(45) Date of Patent: Nov. 24, 2020

(54) TELESCOPING BOARD FOR INSTRUMENT PEDALS

(71) Applicant: D'Addario & Company, Inc., Farmingdale, NY (US)

(72) Inventors: Zachary Stringham, New York, NY (US); Mark William Boycott, Ottawa (CA)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 16/775,609

(22) Filed: Jan. 29, 2020

(65) Prior Publication Data

US 2020/0251078 A1 Aug. 6, 2020

Related U.S. Application Data

(60) Provisional application No. 62/799,944, filed on Feb. 1, 2019.

(51) Int. Cl.
*G10G 5/00* (2006.01)
*G10H 1/34* (2006.01)

(52) U.S. Cl.
CPC ..... *G10G 5/00* (2013.01); *G10H 1/348* (2013.01); *G10H 2220/155* (2013.01); *G10H 2230/365* (2013.01)

(58) Field of Classification Search
CPC .... G10H 1/348; G10H 1/0058; G10H 1/0066; G10H 1/0083; G10H 2230/035; G10H 2240/211
USPC ..... 84/644, 721
See application file for complete search history.

(56) References Cited

U.S. PATENT DOCUMENTS

| | | | | |
|---|---|---|---|---|
| 5,866,829 | A | 2/1999 | Pecoraro | |
| 6,215,055 | B1 * | 4/2001 | Saravis | G10H 1/348 84/422.1 |
| 6,459,023 | B1 * | 10/2002 | Chandler | G10H 1/32 84/177 |
| 6,538,185 | B1 | 3/2003 | Stratton | |
| 7,485,792 | B2 | 2/2009 | Collins, Sr. | |
| 8,138,406 | B2 | 3/2012 | Vinciguerra | |
| 8,614,385 | B2 | 12/2013 | McKinney et al. | |

(Continued)

FOREIGN PATENT DOCUMENTS

| | | |
|---|---|---|
| EP | 2950303 B1 | 7/2018 |
| GB | 2544517 A | 5/2017 |

OTHER PUBLICATIONS

The Les Paul Forum, retrieved from https://www.lespaulforum.com/forum/showthread.php?162077-A-Better-Alternative-To-Velcro (shows zip tie example Oct. 2, 2009).

*Primary Examiner* — Jeffrey Donels
(74) *Attorney, Agent, or Firm* — Alix, Yale & Ristas, LLP

(57) ABSTRACT

A telescopically adjustable board for mounting musical instrument pedals includes a first inner rail-outer rail pair. The outer rail has a tubular shape defining a hollow track and the inner rail is slidably received within the hollow track with the outer rail circumscribing the inner rail. Each of the inner rail and outer rail is configured to fixably attach to a musical effects pedal. The board may include a second inner rail-outer rail pair substantially parallel to and spaced from the first inner rail-outer rail pair. The inner rails are slidable relative to the outer rails between a fully extended position and a fully retracted position to adjust the longitudinal length of the board.

20 Claims, 17 Drawing Sheets

(56) References Cited

U.S. PATENT DOCUMENTS

| | | | | |
|---|---|---|---|---|
| 9,401,133 | B2 | 7/2016 | McGinly | |
| D769,364 | S * | 10/2016 | Trifilio | D17/20 |
| D781,954 | S | 3/2017 | Wilfer | |
| 9,620,094 | B2 | 4/2017 | Abbate | |
| D787,583 | S | 5/2017 | Canivell Grifols et al. | |
| D789,442 | S | 6/2017 | Canivell Grifols et al. | |
| 9,691,369 | B2 * | 6/2017 | Trifilio | G10D 1/085 |
| D795,334 | S | 8/2017 | Kreifeldt et al. | |
| D815,682 | S * | 4/2018 | Trifilio | D17/20 |
| D819,120 | S | 5/2018 | Wilfer | |
| D819,726 | S | 6/2018 | Belitz et al. | |
| 9,997,149 | B2 * | 6/2018 | Trifilio | G10D 1/085 |
| 10,008,192 | B2 * | 6/2018 | Kreifeldt | G10G 5/00 |
| 10,163,430 | B2 | 12/2018 | Jashyn | |
| 10,204,609 | B2 | 2/2019 | Canivell Grifols | |
| 2007/0295190 | A1 * | 12/2007 | Collins | G10H 1/32 84/422.1 |
| 2011/0271821 | A1 * | 11/2011 | McKinney | G10H 1/348 84/746 |
| 2011/0303077 | A1 * | 12/2011 | Vinciguerra | G10H 1/0091 84/746 |
| 2014/0131543 | A1 * | 5/2014 | Goto | F16M 11/043 248/429 |
| 2015/0325224 | A1 * | 11/2015 | Manosa Ripoll | G10H 1/34 84/444 |
| 2017/0098438 | A1 * | 4/2017 | Trifilio | G10G 5/00 |
| 2017/0206879 | A1 | 7/2017 | Fiden et al. | |
| 2017/0243572 | A1 * | 8/2017 | Trifilio | G10H 1/342 |
| 2018/0151162 | A1 | 5/2018 | McKenzie | |

* cited by examiner

TELESCOPING BOARD FOR INSTRUMENT PEDALS

BACKGROUND OF THE DISCLOSURE

The present disclosure relates to boards for mounting musical instrument pedals, commonly referred to as "pedalboards." More particularly, the disclosure relates to pedalboards with adjustable lengths via telescopic movement of tubular members.

In the musical instrument field, pedalboards are used typically with guitars as a package, patch bay and power supply for effects pedals for use in altering the sounds and characteristics of electric guitars. At its core, a pedalboard provides a surface that is mechanically attachable to pedals and can also include a power supply and power cables or jacks, in order to power and connect to multiple different pedals. Pedalboards also assist a player in managing multiple pedals by allowing a single contained pedalboard with numerous mounted or attached pedals to be moved, packed or transported without disassembly. Pedals can be secured to boards in a variety of manners, such as via magnet, hook and loop fasteners, ties, clips or similar.

As players accumulate more pedals or opt to use different numbers of pedals for a given performance, a common problem exists in that most known pedalboards are not adjustable in size, and thus adjustable in capacity for different quantities of pedals. One adjustable pedalboard exists that utilize a pair of large flat members that slide relative to each other expand and contract size of the mounting surface. These known solutions fall short in that some can be cumbersome, not robust, provide no mechanism for organizing cables and other related accessories, and/or provide only limited adjustability.

It would thus be useful to have a pedalboard with a capacity that can be adjusted as desired by a user, and which solves the drawbacks associated with existing pedalboards. The disclosed embodiments achieve this adjustability via cooperative tubular members that are attached telescopically relative to one another to optionally change size.

SUMMARY

In one embodiment, a board for mounting musical instrument pedals includes a first elongate outer rail, a second elongate outer rail, a first elongate inner rail and a second elongate inner rail. The first and second outer rails each have a tubular configuration, extending longitudinally and defining a longitudinal inner track with a top mounting surface. The first inner rail is received within the inner track of the first outer rail and a second inner rail is received within the track of the second outer rail. The first and second inner rails each define a top mounting surface. Each inner rail is longitudinally slidable within the inner central track of the respective outer rail to allow adjustment of the longitudinal length of the board between a fully extended position and a fully retracted position. The top mounting surface of the outer rails and the top mounting surface of the inner rails are configured for attachment to a musical instrument pedal.

In another embodiment, a board for mounting musical instrument pedals includes a first inner rail-outer rail pair. The outer rail has a tubular shape defining a hollow track and the inner rail is slidably received within the hollow track with the outer rail circumscribing the inner rail. Each of the inner rail and outer rail is configured to fixably attach to a musical effects pedal.

In yet another embodiment, a board for mounting musical instrument pedals comprises a plurality of longitudinally extending inner rails with each inner rail having a longitudinally elongate groove. The board also has a plurality of longitudinally extending outer rails with each outer rail having a longitudinally elongate guide projection. Each inner rail is engaged with an outer rail and slidable relative thereto between a fully retracted position defining a minimum length of the board and a fully extended position defining a maximum length of the board. The respective elongate guide projection is received and extends longitudinally within the respective elongate groove and each engaged inner rail and outer rail form an inner rail-outer rail pair. The board is inclined in a lateral direction opposite from the longitudinal direction such that a forward inner rail-outer rail pair is maintained higher than a rearward inner rail-outer rail pair.

BRIEF DESCRIPTION OF THE DRAWINGS

Aspects of the preferred embodiment will be described in reference to the drawings, where like numerals reflect like elements.

DETAILED DESCRIPTION

Figure 1:
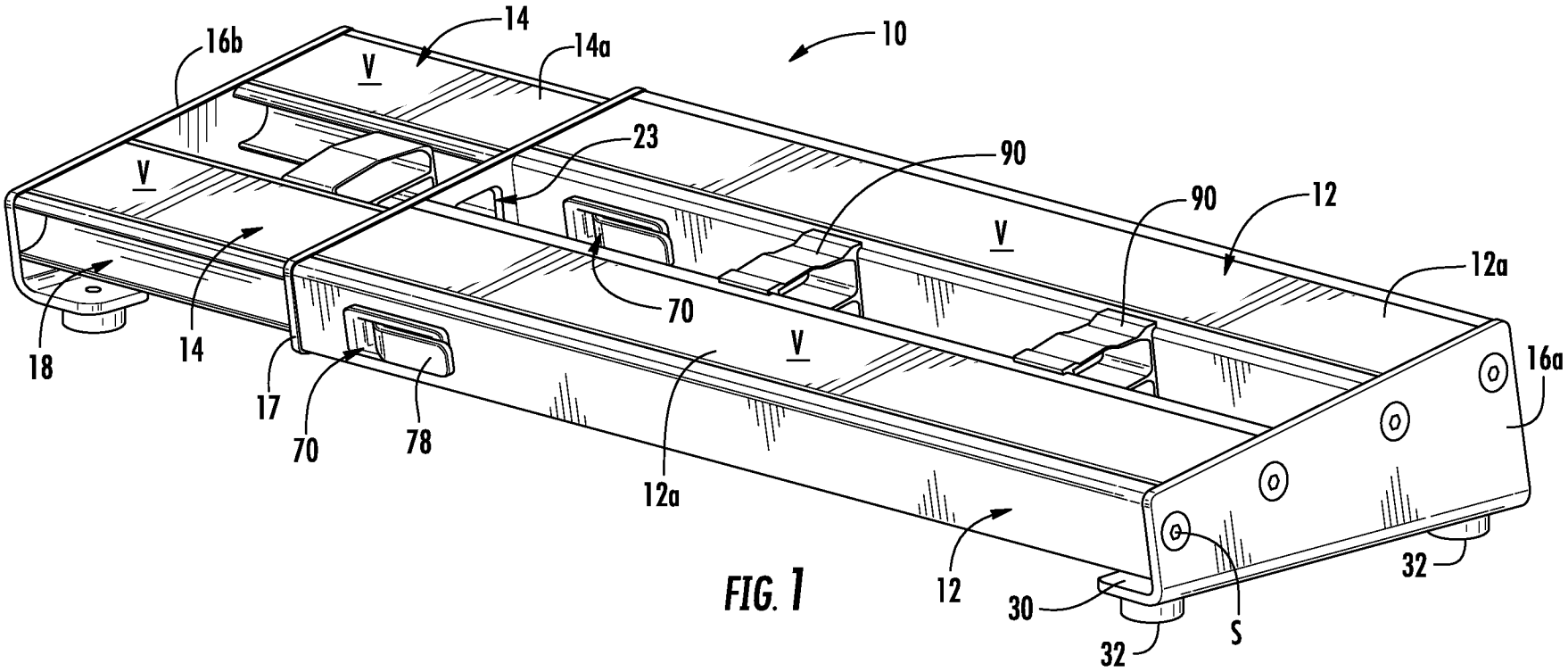
FIG. 1 is a perspective view of an embodiment of the disclosed pedalboard.

Among the benefits and improvements disclosed herein, other objects and advantages of the disclosed embodiments will become apparent from the following wherein like numerals represent like parts throughout the several figures. Detailed embodiments of a telescopically-adjustable pedalboard with tubular rails are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the Figures, embodiments of the disclosed pedalboard 10, 100 and 200 are shown. The inventive features will be discussed herein primarily with respect to the first embodiment of the pedalboard 10 in FIG. 1. Each of the disclosed embodiments includes overlapping core features of cooperative tubular rails spaced apart from each other, among other common features. As shown, the embodiments of the pedalboard comprise a series of elongate tubular outer rails 12, each outer rail receiving an elongate inner rail 14 that may also have a tubular shape. Each inner rail 14 is sized and shaped to be received within an inner track defined within the walls of an outer rail 12. An end cap or plate 16*a* is attached at the outer terminal ends of each outer rail 12 and an opposite end cap 16*b* is attached at the outer terminal ends of each inner rail 14. The end caps, 16*a* and 16*b*, can be designed with cut-outs, flanges or other features for accommodating additional elements for use with the pedalboard 10 like an electrical assembly, cables, or other pedal accessories. Each of the outer and inner rails 12 and 14 defines a substantially flat top surface 12*a*, 14*a*, respectively, configured to receive and mount one or more musical effects pedals. The top surfaces, 12*a* and 14*a*, can include attachment members V for pedals, such as one of two cooperative sides of a hook and loop fastening system (i.e., Velcro® or Command™ branded fasteners) with the pedals having the second cooperative side of the hook and loop system. Other attachment members can be used, such as magnets, ties or adhesives, for example.

Figure 24:
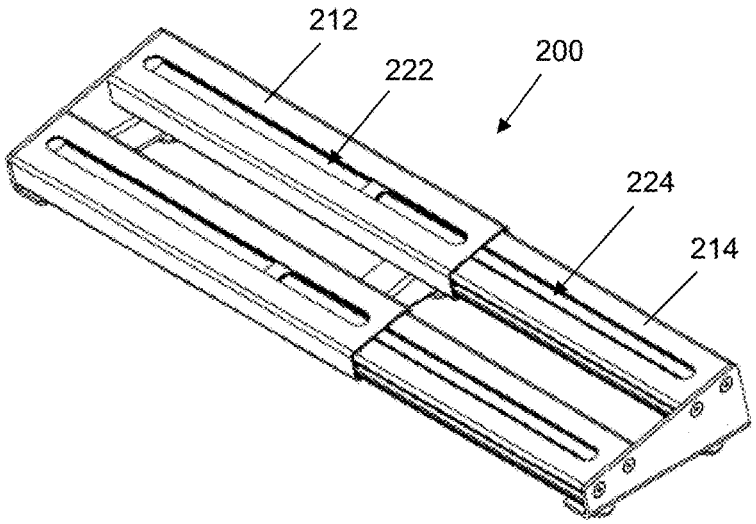
FIG. 24 shows another embodiment of the disclosed pedalboard with slots machined in the top surfaces of each tubular inner rail and outer rail.

Another embodiment of the disclosed pedalboard 200 exists as shown generally in FIG. 24, wherein the outer rails 212 and inner rails 214 each defines an elongate slot, 222 and 224, in its top surface. The upper slots 222 and 224 can be used for mechanically attaching or mounting intermediate members and hardware optionally used to secure music pedals. Such intermediate members include, for example, magnetic plates, Velcro® plates, clips and/or brackets for mechanically securing pedals.

Figure 12:
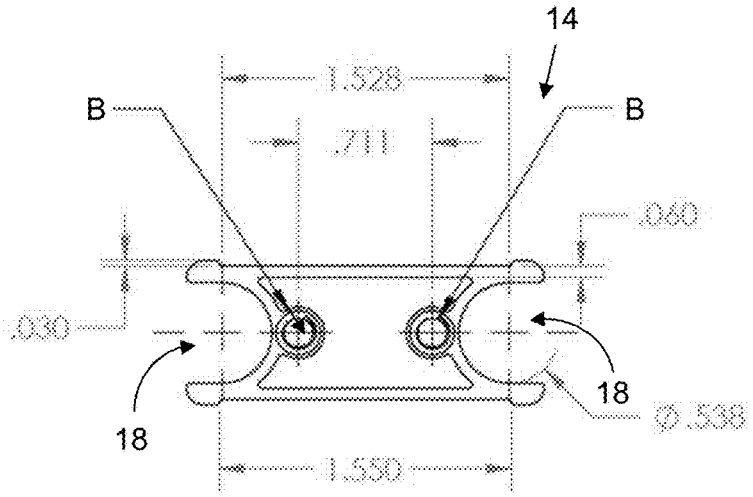
FIG. 12 is a longitudinal end view of an inner rail of the pedalboard.
Figure 13:
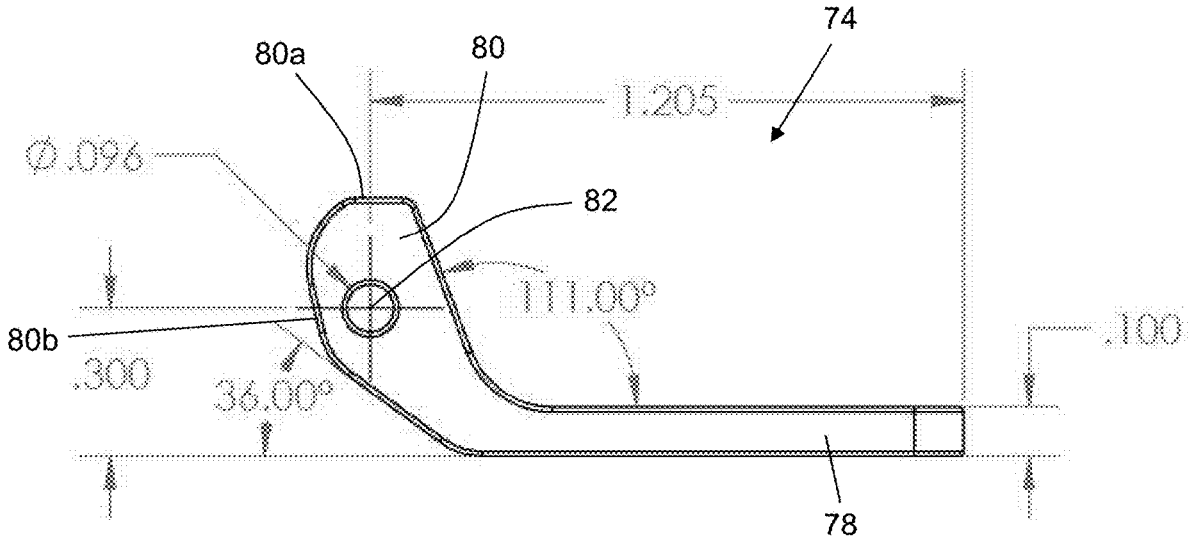
FIG. 13 shows a locking cam of the disclosed pedalboard in isolation.

As can be seen most clearly in the cross-sectional views of FIGS. 8 and 12, each of the outer rails 12 and inner rails 14 is has a modified "tubular" shape. As used herein, the term "rear" as modifying the rails refers to the bottom set of rails attached at a lower elevation in the view of the Figures; the term "front" as modifying the rails refers to the top set of rails attached at a higher elevation in the view of the Figures; and "longitudinal" as relates to the rails refers to the direction in which they extend between the end plates. The depicted relative elevation of the rear and front rails is simply characteristic of a preferred embodiment, and in no way limits the scope of the inventive concepts.

The outer rails 12 preferably include substantially flat top and bottom faces space apart by flat front and rear faces forming a hollow substantially rectangular prismic overall shape. The inner rails preferably have flat top and bottom faces and concave front and rear faces that form alignment grooves 18. Like the outer rail 12, the inner rail has a closed hollow shape. In other embodiments, the front and rear faces need not be concave in their entireties, and can rather be substantially flat with an elongate groove in a middle portion.

With further reference to FIG. 12, the front and rear faces of the inner rails 14 includes a side groove 18 in at least one of its front or rear sides. Preferably, the inner rails 14 have parallel and substantially identical side groove on both the front and rear sides, as shown. In this preferred embodiment, the side grooves extend longitudinally along the entire extent of the inner rails 14. Embodiments exist with side grooves that terminate at a predetermined location along the longitudinal extend of the inner rails 14, which fixes the longitudinal extend of the expansion of the board.

Each side groove 18 is configured to receive a nub or elongate guide projection 20 extending from the front and/or rear surface(s) of the outer rail 12 within which the respective inner rail 14 is slidably positioned. In the depicted embodiments, the guide projections 20 also extend longitudinally along the entire extent of the outer rails 12, which aids stability and rigidity of the board in all positions of expansion. With reference to FIG. 8, the guide projections may include one or more guide ribs 21 projecting radially outward. When the board 10 is assembled with inner rails 14 received within outer rails 12 and guide projections 20 engaged within the grooves 18, the ribs 21 form the contact points against the surface of the grooves 18, which acts to reduce frictional contact area. The configuration of a guide 20 within a groove 18 secures the inner rails 14 and outer rails 12 in a parallel slidable telescopic relationship and maintains consistent clearance spacing between the top and bottom surfaces of the respective rails, 12 and 14. As discussed above, the contact points between the guide projections 20 and surface defining the grooves 18 are the ribs 21, which reduces friction. Non-depicted embodiments of the pedalboard exist wherein the relative positioning of the guide projections and grooves are reversed—that is, the outer tubular rails have surfaces that define elongate grooves that receive guide projections that extend outward from the front and rear faces of the inner tubular rails.

Figure 2:
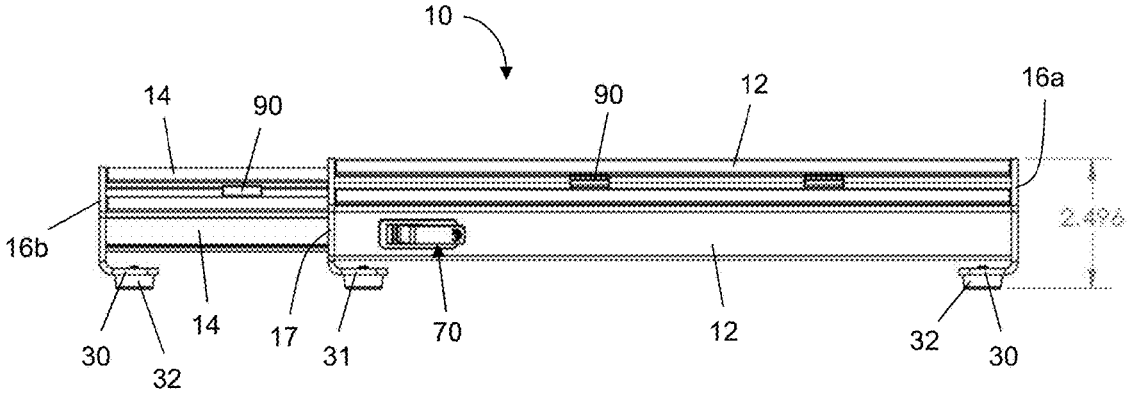
FIG. 2 is a front side view of the pedalboard of FIG. 1 showing the board in an intermediate position of expansion between a fully expanded position and a fully retracted position.
Figure 3:
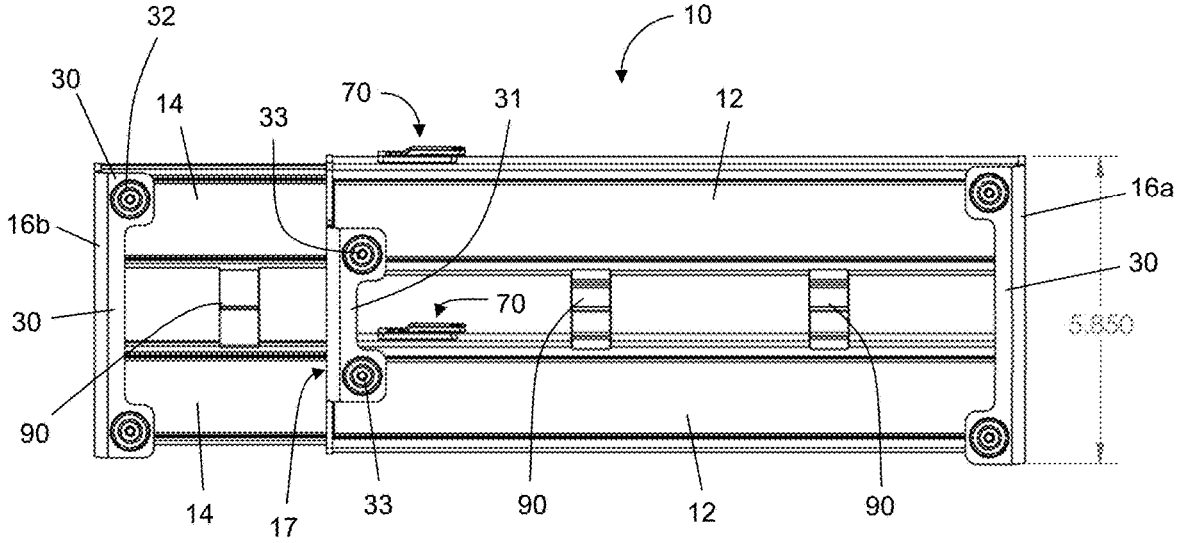
FIG. 3 is a bottom view of the board shown in FIG. 2.
Figure 4:
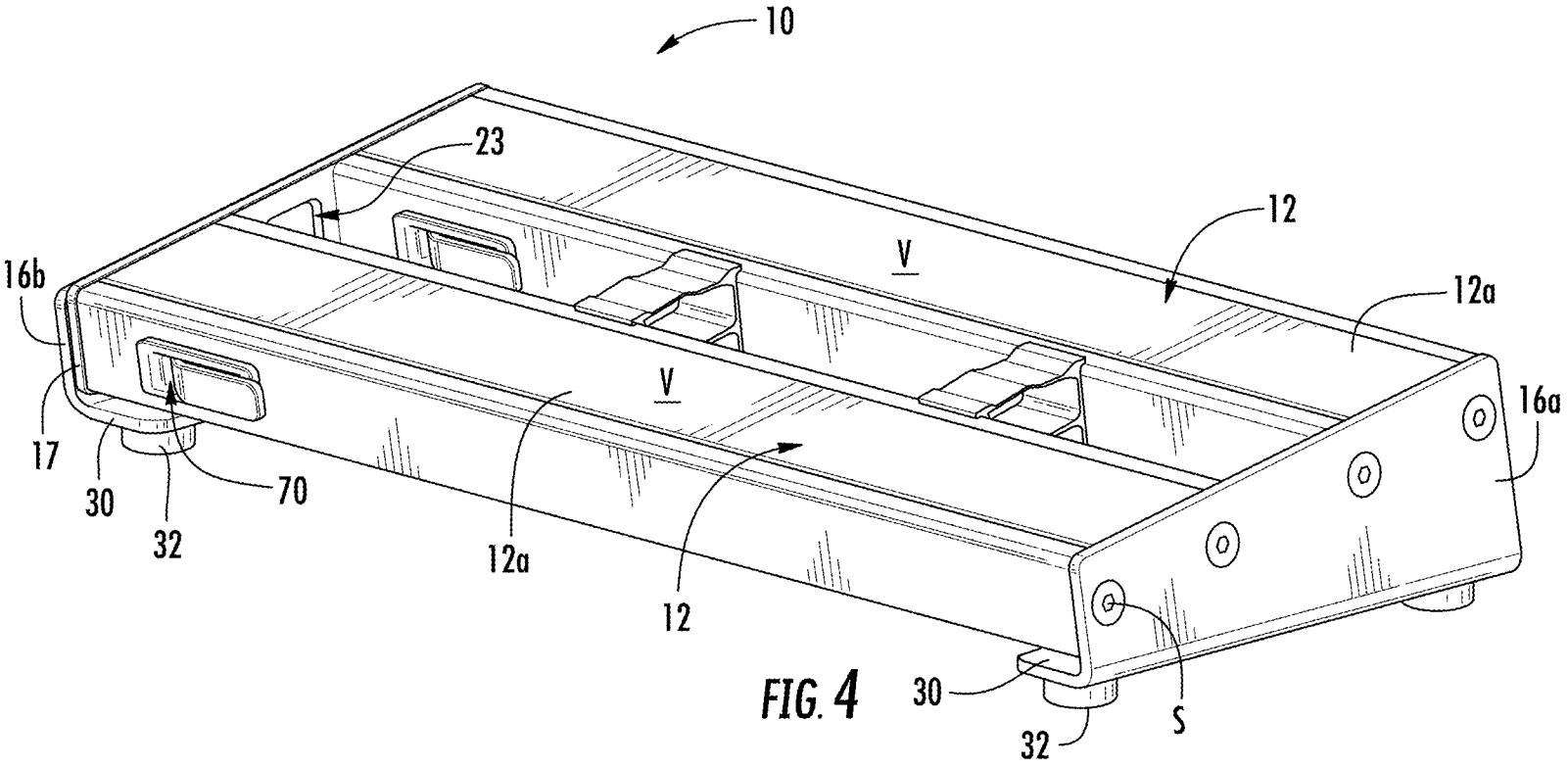
FIG. 4 shows the board of FIG. 1 in a fully retracted position.
Figure 5:
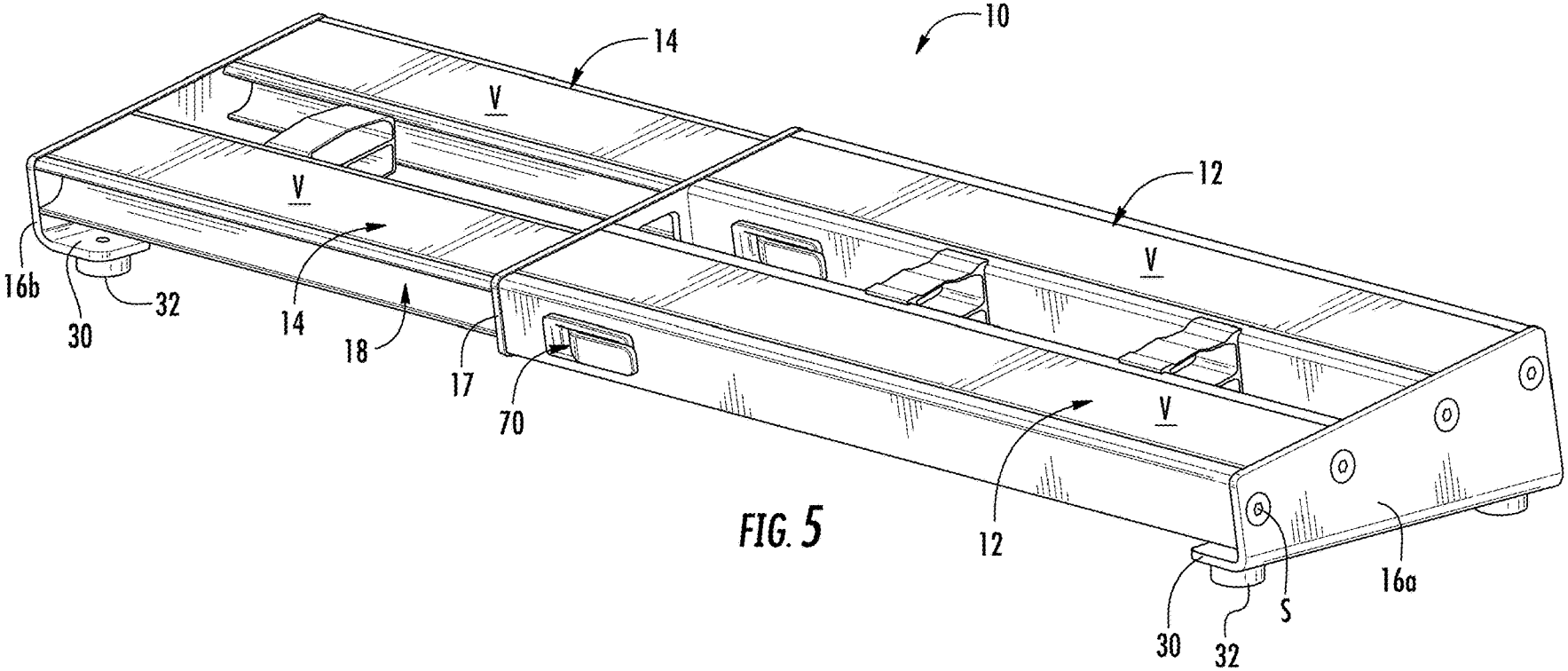
FIG. 5 shows the board of FIG. 1 in a fully expanded position.
Figure 6:
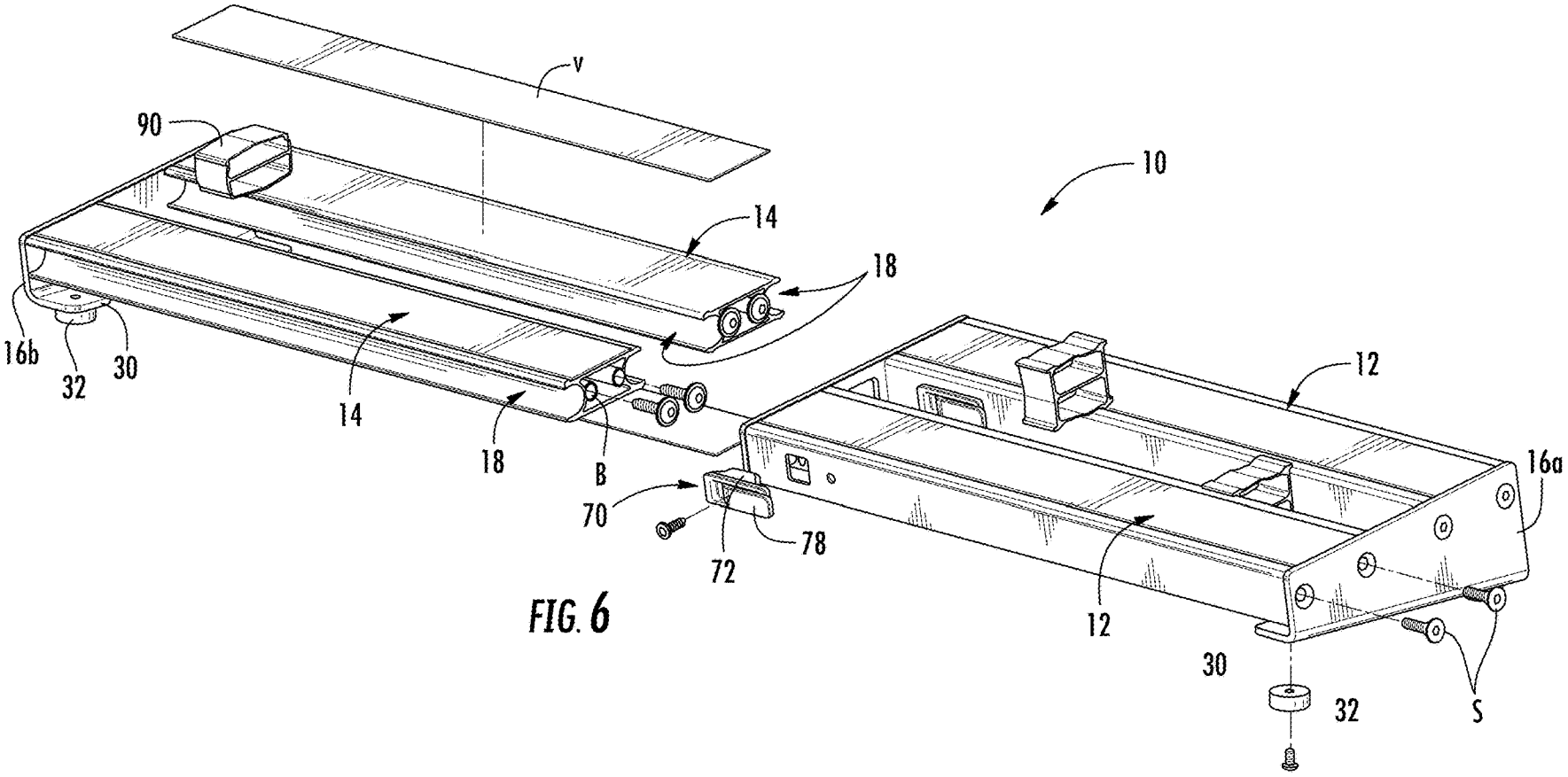
FIG. 6 is an exploded view of the board of FIG. 1.

The view in FIG. 5 shows the pedalboard 10 in a longitudinally extended position with the inner rails 14 extended out from the tracks defined within the outer rails 12, yielding a pedalboard with greater length and thus more top surface space to mount effects pedals. FIG. 4 shows a view of the same pedalboard 10 in a longitudinally retracted position with the inner rails 14 retracted into and concealed within the outer rails 12, yielding a more compact pedalboard 10 with less surface space for mounting pedals than in the extended position of FIG. 5. Notably, FIGS. 5 and 4, respectively, depict extremes—a fully extended position and a fully retracted position. The tubular rails 12 and 14 can be fixed relative to one another in any intermediate position between the fully extended position and fully retracted position, providing comprehensive variability in length. FIGS. 1-3 depict an exemplary intermediate position. As will be discussed in detail below, the pedalboard 10 is lockable in any position via locking members 70 that operate via a releasable cam.

Figure 7:
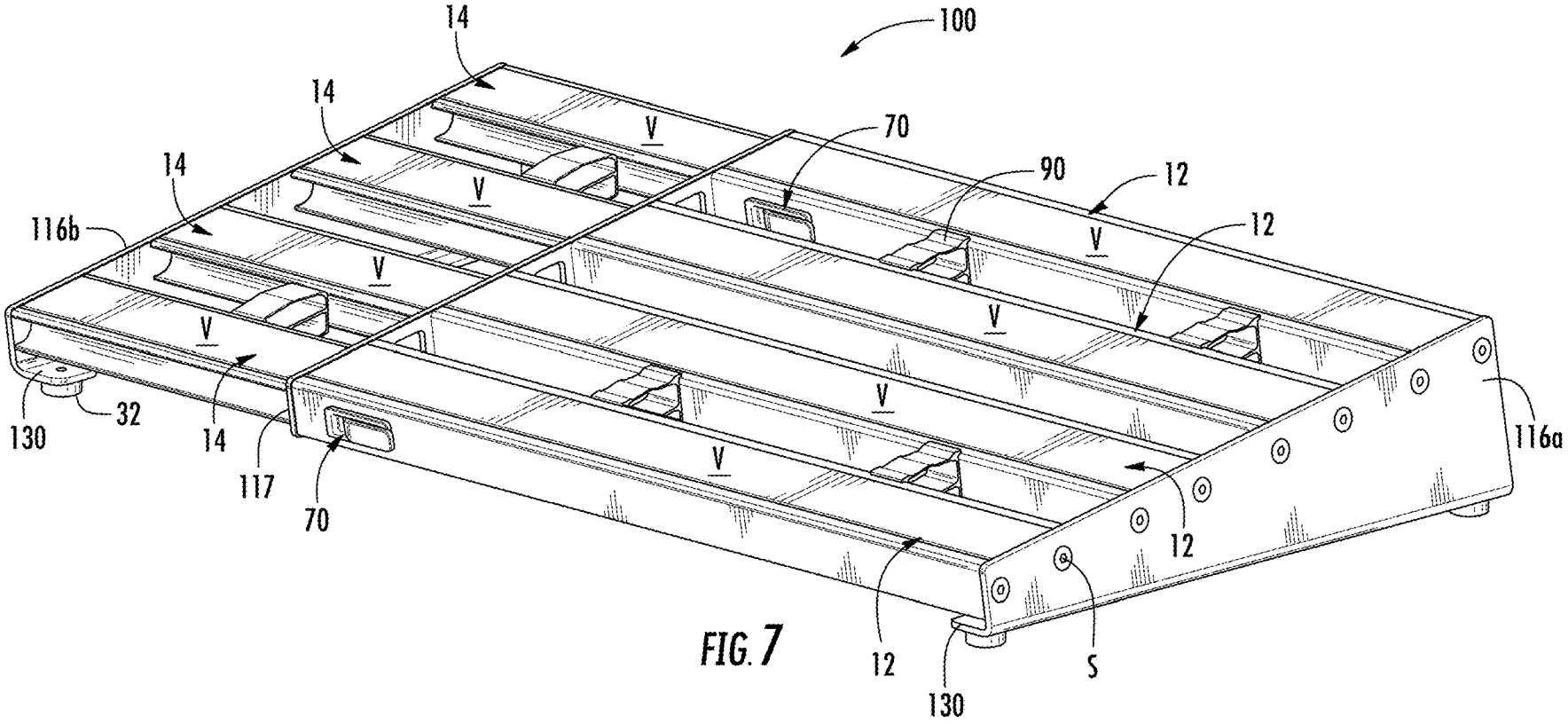
FIG. 7 shows another embodiment of the disclosed pedalboard with four pairs of rails.

FIG. 7 shows another embodiment of a pedalboard 100 with substantially the same elements and relationships as the pedalboard 10. The only substantive difference is that the pedalboard 100 includes four spaced apart outer rail (12)/inner rail (14) pairs, instead of two pairs as in the earlier embodiment of the pedalboard 10. FIG. 7 shows the pedalboard 100 fixed in an intermediate position with the inner rails 14 partially extended from the outer rails 12. The individual elements of the pedalboard 100 are substantially identical to those of the pedalboard 10, with exception to the end plates, 116*a*, 116*b* and 117, and respective bases 130 (intermediate end plate base is concealed in FIG. 7), which are larger to accommodate a greater number of spaced apart rails.

As shown with reference to the embodiment of the pedalboard 10 from FIG. 1, the pedalboard includes a pair of opposite end plates—one end plate 16*a* attached to the outer terminal end of the outer rails 12 and one end plate 16*b* attached to the outer terminal end of the inner rails 14. The opposite end plates, 16*a* and 16*b*, preferably include a bend, forming an underside base 30 that extends partially underneath the rails 12 and 14. A foot 32 or a similar support element, such as a resilient pad, can be attached to the bottom side of the base 30. The end plates, 16*a* and 16*b*, are secured with screws S or similar elongate fasteners at an outer edge of either the outer rails 12 or inner rails 14. The respective rails 12 and 14 are formed with attachment bores B that are preferably threaded to receive and mate with a screw. As shown in FIGS. 8 and 9, the guide projections 20 of the outer rails 12 define an integral bore B with threading on their terminal ends. FIG. 12 shows the bores B in the inner rail 14 formed as an extension from the surface of the respective grooves 18. The inner rail bores may also include threading for aiding attachment.

Figure 14:
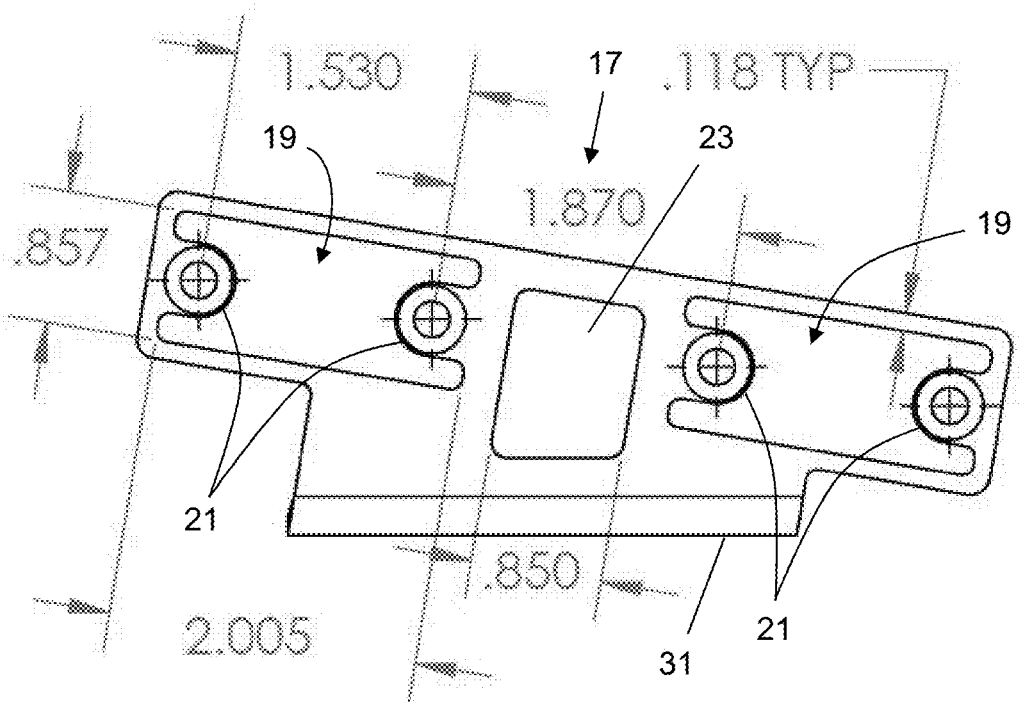
FIG. 14 shows a longitudinal end view of an intermediate end plate of the disclosed pedalboard.
Figure 15:
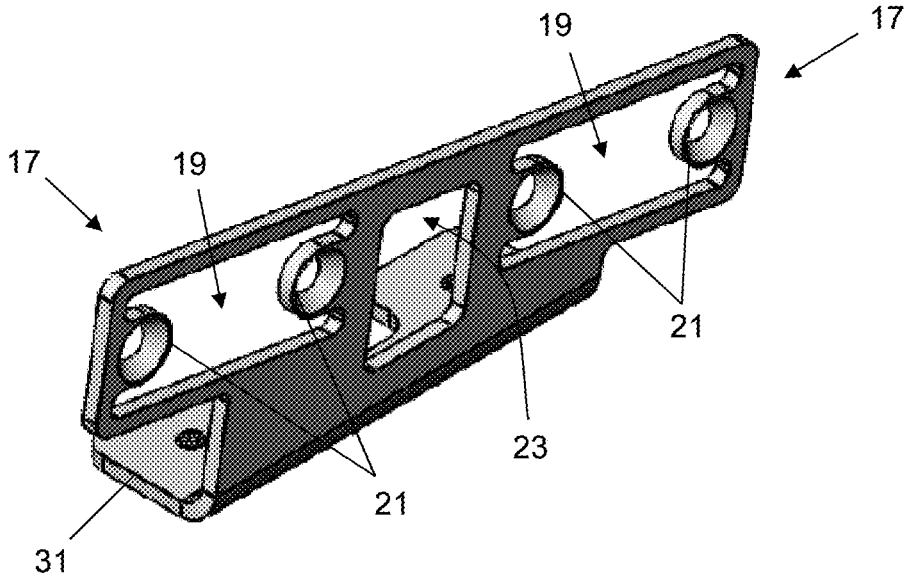
FIG. 15 is a perspective view of the intermediate end plate of FIG. 14.
Figure 16:
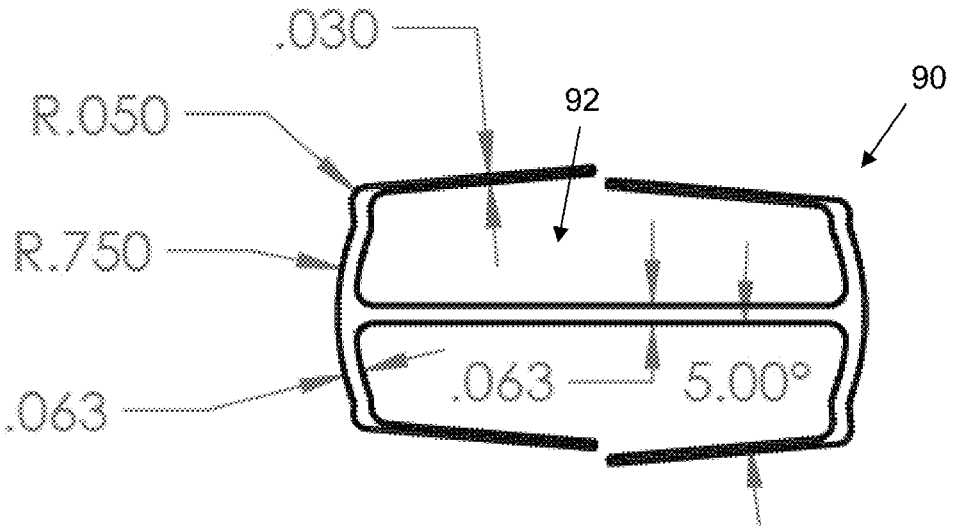
FIG. 16 shows a cable clip insert for installation within the disclosed pedalboard in isolation.
Figure 17:
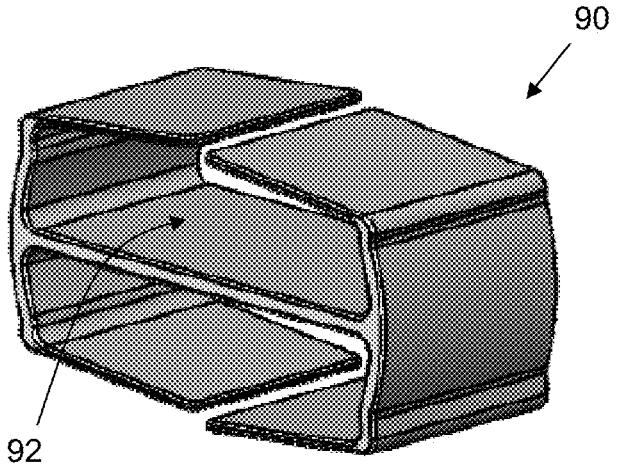
FIG. 17 is a perspective view of the insert of FIG. 16.
Figure 18:
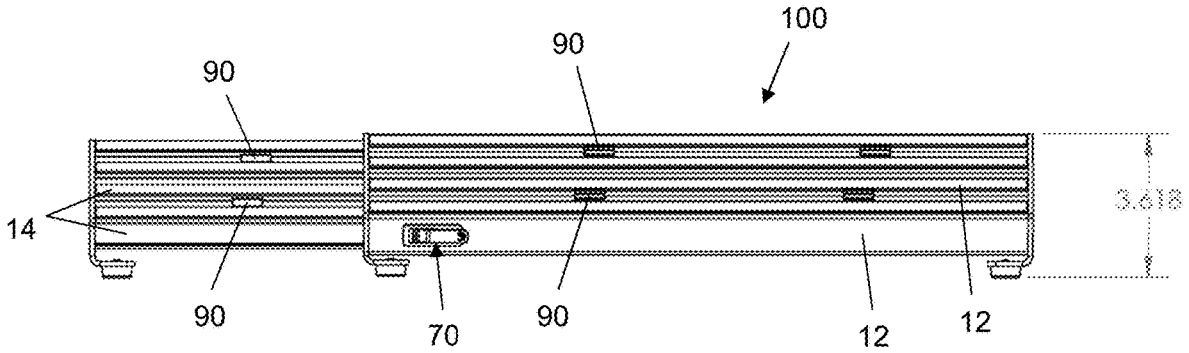
FIG. 18 is a front side view of the pedalboard of FIG. 7 showing the board in an intermediate position of expansion with cable clip inserts installed between adjacent spaced apart inner rails and outer rails.

As shown most clearly in the bottom and front views in FIGS. 2 and 3, the pedalboard 10 may also include an intermediate end plate 17 fixed at the open edge of the outer rails 12 for added stability. Like the end plates 16*a* and 16*b*, the intermediate end plate 17 is formed with a bend to yield a base 31 with feet 33 attached thereto. FIGS. 14 and 15 depict the intermediate end plate 17 in isolation for detail. As can be seen, the intermediate end plate 17 is formed with openings 19 shaped to receive one of the inner rails 14 in a slidable relationship. A set of nubs 21, each defining a through hole for a screw, extend inward from the front and rear edges of the openings 19. Each nub 21 is shaped to define a profile that is commensurate in size and approximate shape (or slightly smaller) with a guide 20 of an outer rail 12. In this manner, the nubs 21 of the intermediate end plate 17 slide along with the guides 20 within the grooves 18 of the inner rails 14 to provide the telescopic relationship. The intermediate end plate 17 also defines a central pass through opening 23 in general alignment with the space between first and second outer rails, through which cables or other wires can pass when in use. The end plate bases, 30 and 31, with feet, 32 and 33, combine to allow mounting of the pedalboard 10 substantially flat on a surface with clearance underneath the rails.

Figure 19:
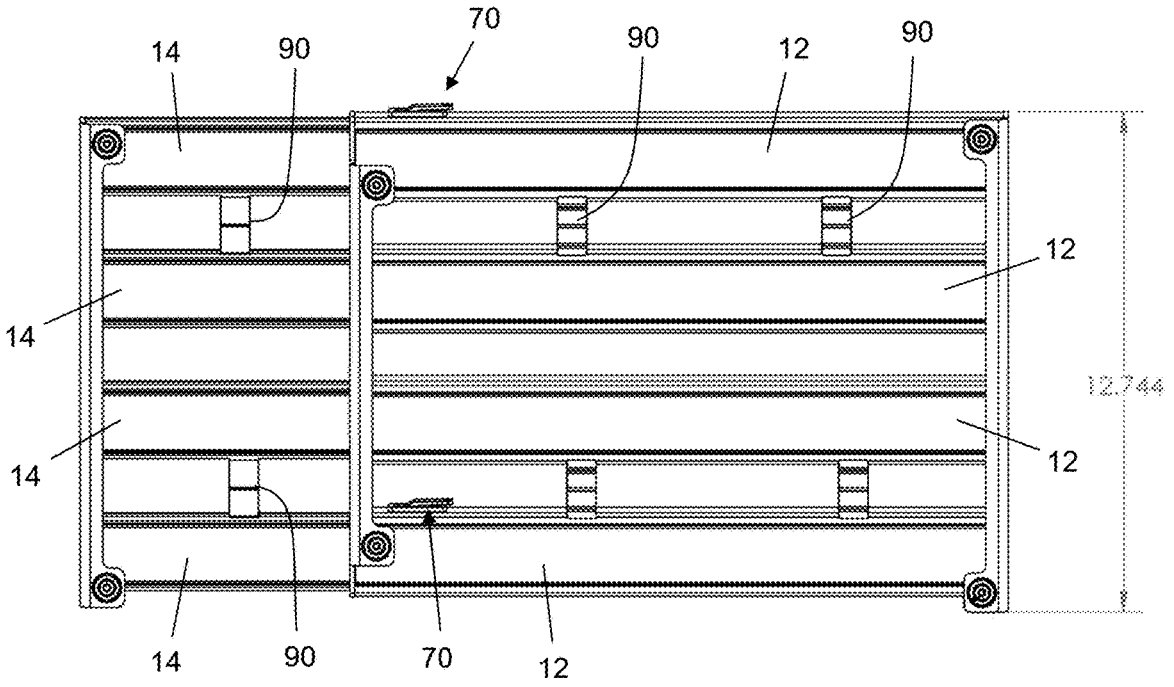
FIG. 19 is a bottom view of the board shown in FIG. 18.

With reference primarily to FIGS. 8A-9B and 13, one or more of the tubular outer rails 12 includes a locking member 70 in one of its surfaces. Preferably, the locking member 70 is positioned in the front surface of the outer face of the at least one outer rail 14 for ease of operation for the musician, however the specific location depicted in the Figures is non-limiting. As can be seen in FIGS. 3 and 19, for example, the board, 10 or 100, has a pair of substantially identical locking members 70.

Figure 8A:
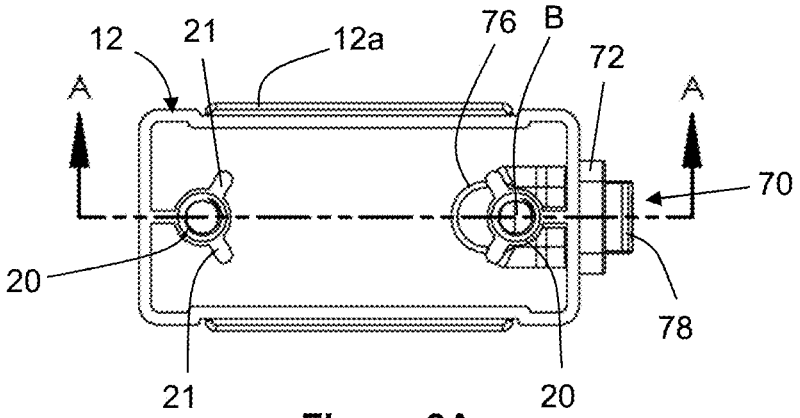
FIG. 8A is a cross-sectional view of an outer rail of the disclosed pedalboard.
Figure 8B:
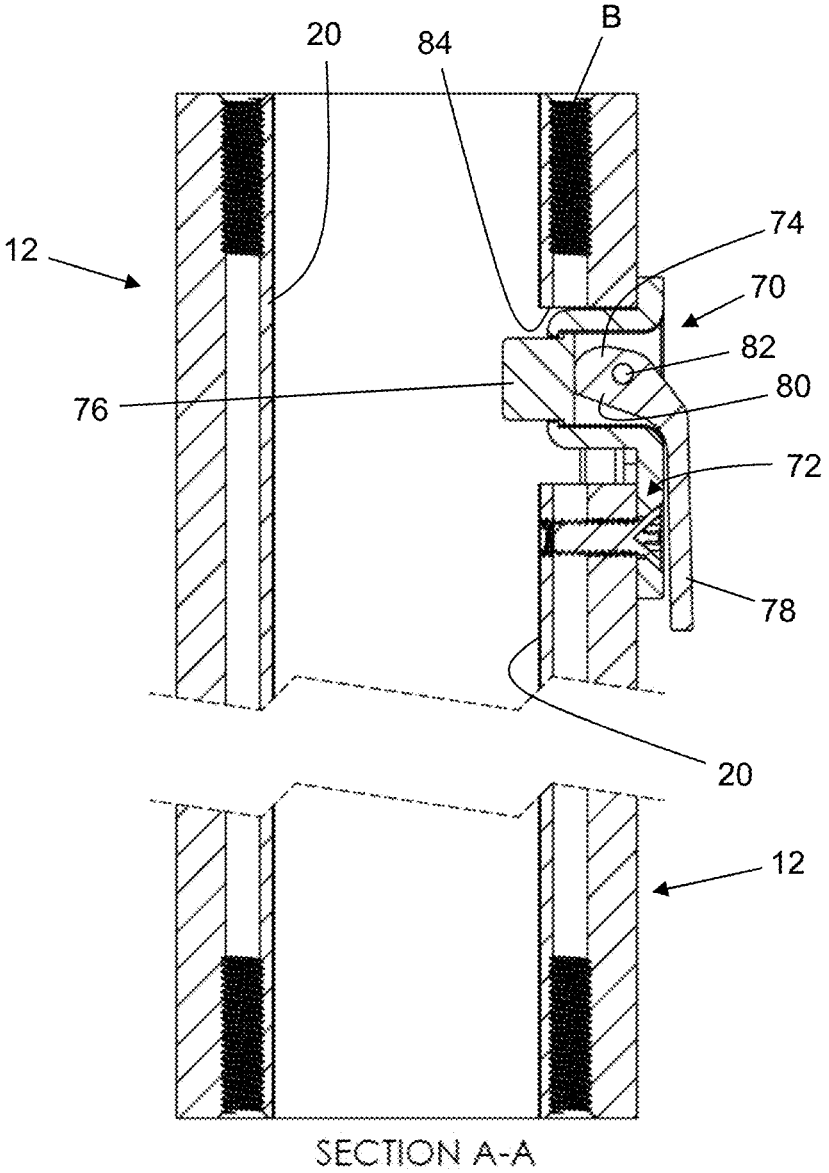
FIG. 8B is a cross-sectional view through line A-A from FIG. 8.
Figure 9A:
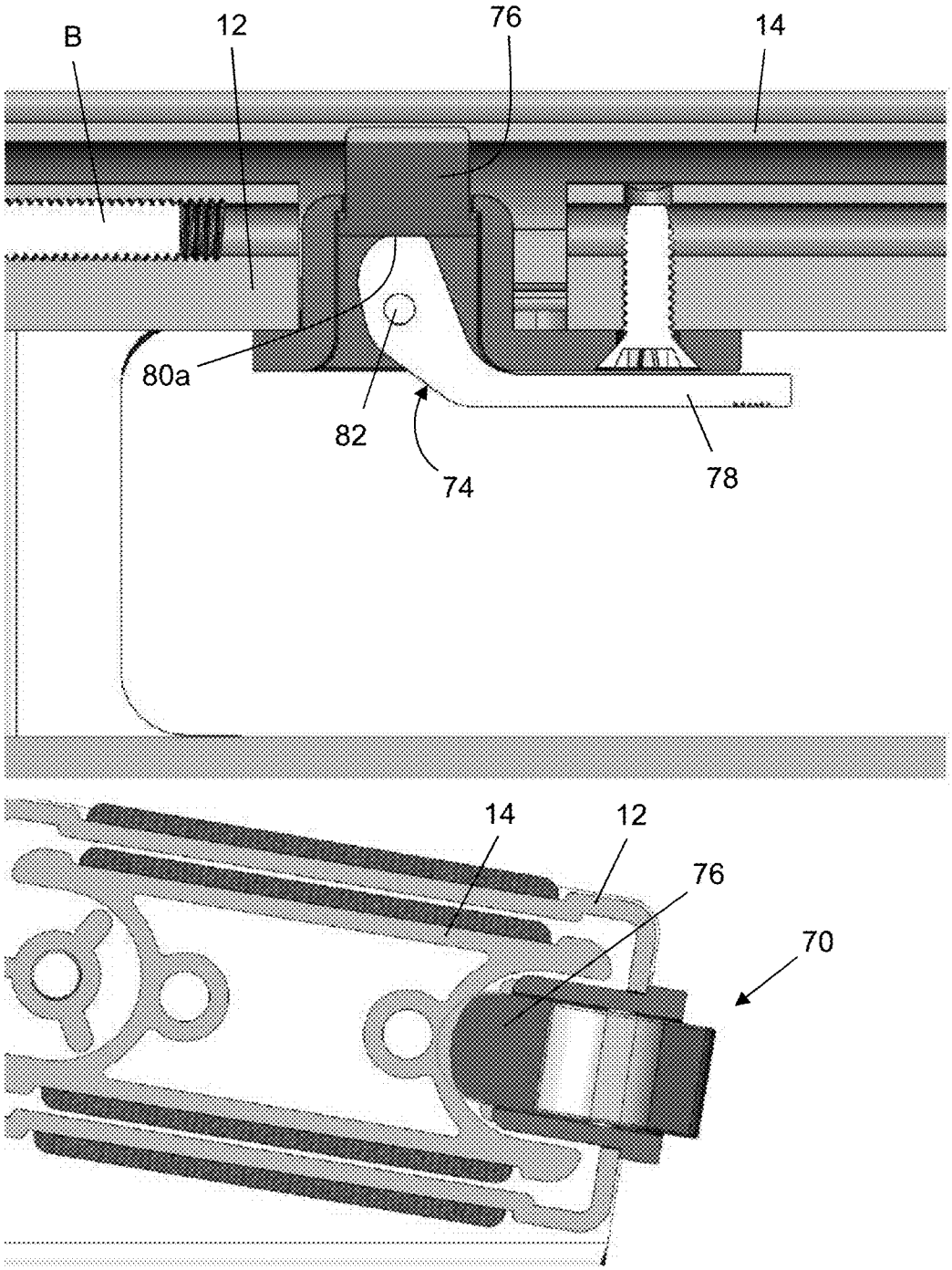
FIG. 9A includes cross-sectional views that show the locking cam in a locked position.
Figure 9B:
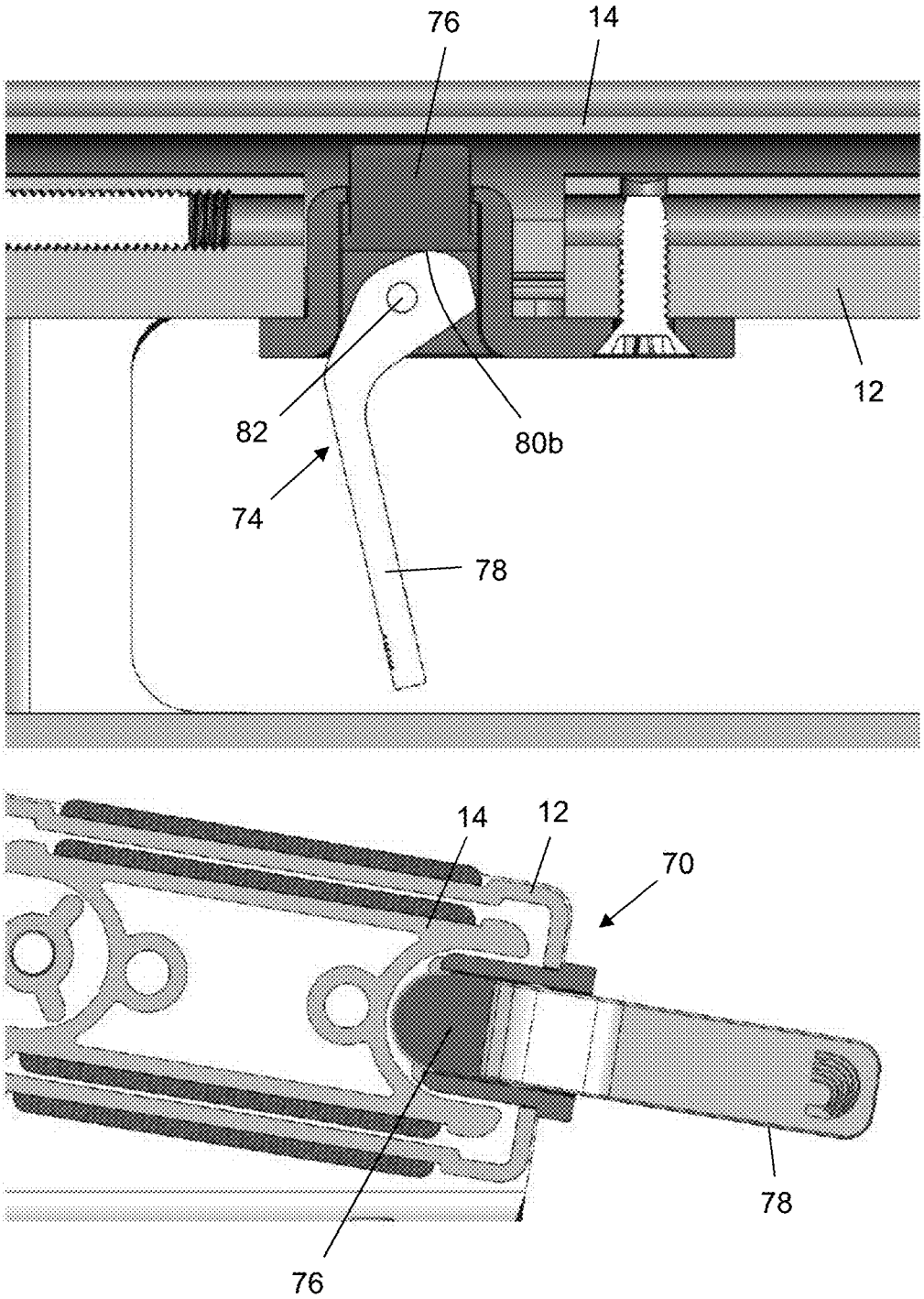
FIG. 9B includes cross-sectional views that show the locking cam in an unlocked position.
Figure 10:
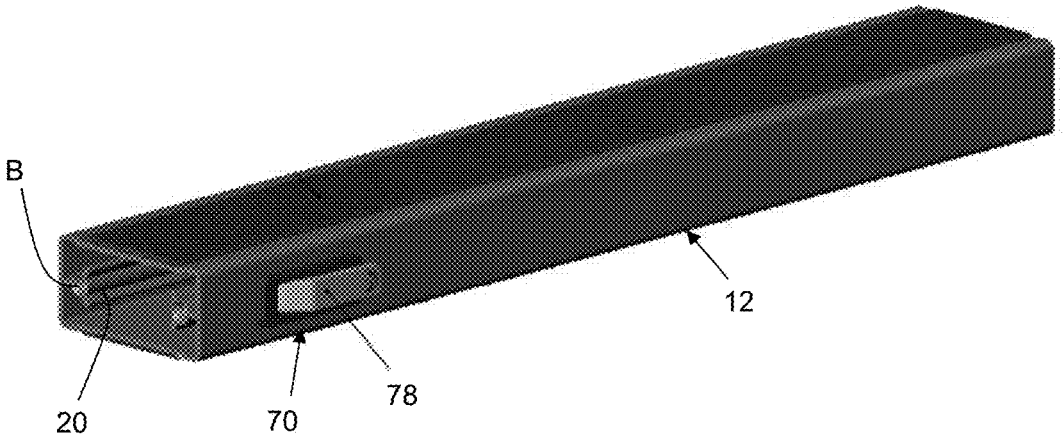
FIG. 10 shows a perspective view of an outer rail of the pedalboard.
Figure 11:
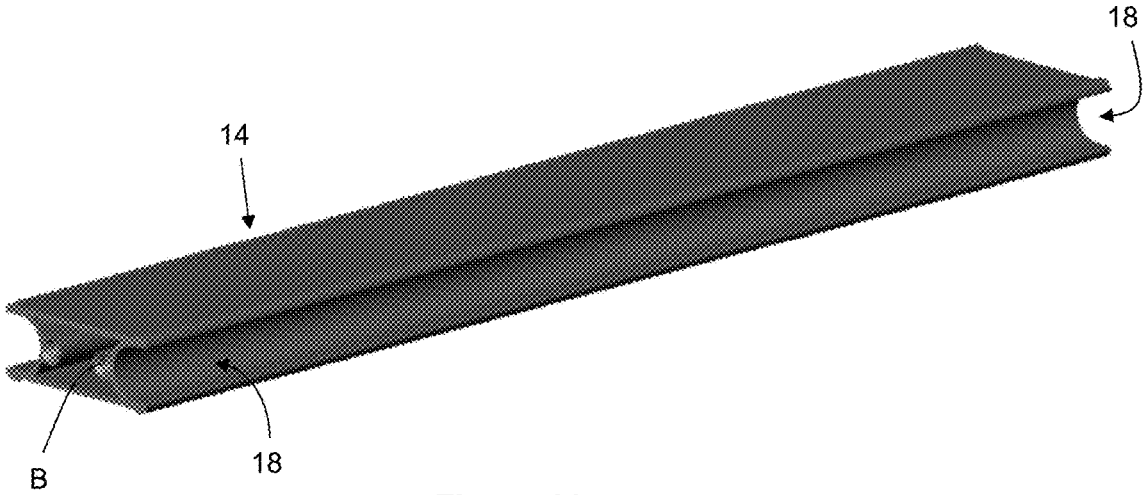
FIG. 11 shows a perspective view of an inner rail of the pedalboard.

The cross-sectional view of FIG. 8B shows an exemplary locking member 70 in greater detail, which includes an outer base 72, a rotatable cam 74 and a friction foot 76. In the isolated view of the cam 74 shown in FIG. 13 and the cross-section of FIG. 9, it can be appreciated that the cam 74 has a lever 78 extending from an irregularly-shaped lobe 80 that is retained in the base 72 with a pin 82 in a rotatable engagement. The base 72 is received and fixed in a slot 84 in the surface of the outer rail 12 with locking member 74 rotatable about the pin 82 between a locked, closed position (shown in FIGS. 8A, 8B and 9A) and an unlocked, opened position via rotation of the lever 78 (shown in FIG. 9B). It can also be appreciated that the cam lobe 80 has an irregular shape with a nose 80*a* and a heel 80*b* with a clearance ramp defined circumferentially therebetween. The nose 80*a* defines an outer surface that extends radially further from the pin 82 than the outer surface defined by the ramp or heel 80*b*. The locking member 70 is preferably shaped such that the lever 78 lies flat against or substantially parallel to the surface of the outer rail 12 in the locked position, which is shown in FIGS. 3, 9 and 19. In the locked position, the lever 78 is pivoted inward, causing the surface on the nose 80*a* to press against the cam foot 76 and force it inward, which compresses and tightens against the surface of the inner rail 14 received within the channel of the outer rail 12. By this operation, the cam foot 76 locks the rails, 12 and 14, in a preferred longitudinal position relative to one another to fix the size of the pedal mounting surface of the pedalboard 10. The cam foot is preferably formed of a durable resilient material that will withstand long-term repeated use as a frictional stopping member against the inner rail 14 to prevent telescopic movement, such as a hard polymeric material or rubber, as non-limiting examples. In this manner, pedalboard 10 is fully adjustable in length and can be locked in any longitudinal position between a fully expanded position (maximum area) and a fully retracted position (minimum area).

As can be seen in the views of FIGS. 8 and 9, the locking member extends inwardly and is aligned with a guide rail 20 in the respective outer rail 12 to which it is attached. The cam foot 76 has an arced cross-sectional shape that approximately matches the shape of the surface of the groove 18 in the inner rail 14. The cam foot 76 may be hollow and thus allow for a moderate degree of flexion when pressed against the surface of the inner rail groove 18. This position of the cam foot 76 can be seen most clearly in FIGS. 8A and 9A. While the inner rail 20 is omitted for clarity in FIGS. 8A and 8B, these Figures depict the locking member 70 in the locked position with the cam 74 pressing the foot 76 inward and the lever 78 substantially flat against the side of the outer rail 12. In the depicted two-rail embodiment of the pedalboard 10, each of the outer rails 12 includes a locking member substantially identical to one another, however embodiments exist that employ less than one locking member per inner rail-outer rail pair. The depicted four-rail embodiment of the pedalboard 100 also includes two locking members 70, although more can be employed as may be needed. Embodiments of the disclosed pedalboard exist that utilize other means of longitudinally locking the rails relative to one another, which include screw, latch or ratchet tightening/locking, for example.

With reference to FIGS. 16-19, embodiments of the pedalboard, 10, 100 and 200, are configured to receive one or more cable clip inserts 90 within the spacing between adjacent inner rail-outer rail pairs. The cable clip inserts 90 are formed of a partially flexible, compressible and/or bendable material that retains sufficient rigidity to hold cables or other wires within its slots 92, such as a polymer, silicon or rubber. In the depicted embodiment, inserts 90 simply compress within the spacing between adjacent rails, 12 and/or 14, and are maintained in the position via friction fit, however other embodiments exist that attach in different manners such as mechanically, magnetically and/or via adhesive. The cable clip inserts 90 operate to hold audio or power cables that may be positioned in the spacing between tubular rails and thus assist an artist in maintaining an organized and contained pedalboard.

Figure 22:
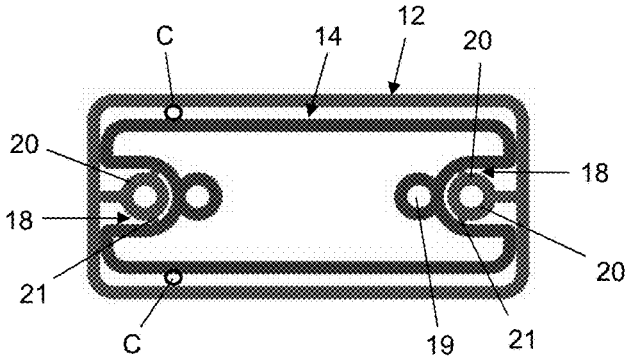
FIG. 22 shows a cross-sectional view of the telescopic relationship of an inner rail within a track defined by an outer rail and alignment via guides and grooves.

Each of the tubular rails, 12 and 14, is preferably formed as a singular hollow piece by an extrusion process. The inner rail 14 is extruded with a front and rear side groove 18 and the outer rail 12 is extruded with cooperative front and rear guide members 20. As discussed above, the guide members 20 may include a pair of ribs 21 that project radially and help mount the guide 20 firmly within the respective groove 18 while minimizing frictional contact with the groove surface. The inner and outer rails may also include integral end bores B with screw flutes for attaching the end plates, 16*a*, 16*b* and 17, with screws. In the depicted preferred embodiment, the screw flutes are formed integrally within the guide members 20 of the outer rail 12, and on an inner portion of the side grooves 18 on the inner rail 14, however this is a non-limiting characteristic. FIG. 22 shows cross-sectional profiles of the tubular rails 12 and 14. As shown, the side grooves 18 and guide members 20 with ribs 21 are sized and shaped to cooperate to maintain a consistent clearance C between the inner rail 14 and outer rail 12 on both the top and bottom surfaces and to reduce surface-to-surface friction between the inner rails 14 and outer rails 12.

FIG. 24 shows yet another embodiment of the board 200 with slots 222 and 224 machined in the top and bottom surfaces of the tubular rails 212 and 214. The slots in the rails can be used for attachment of other items, such as clips, power supplies and/or cables.

Figure 20:
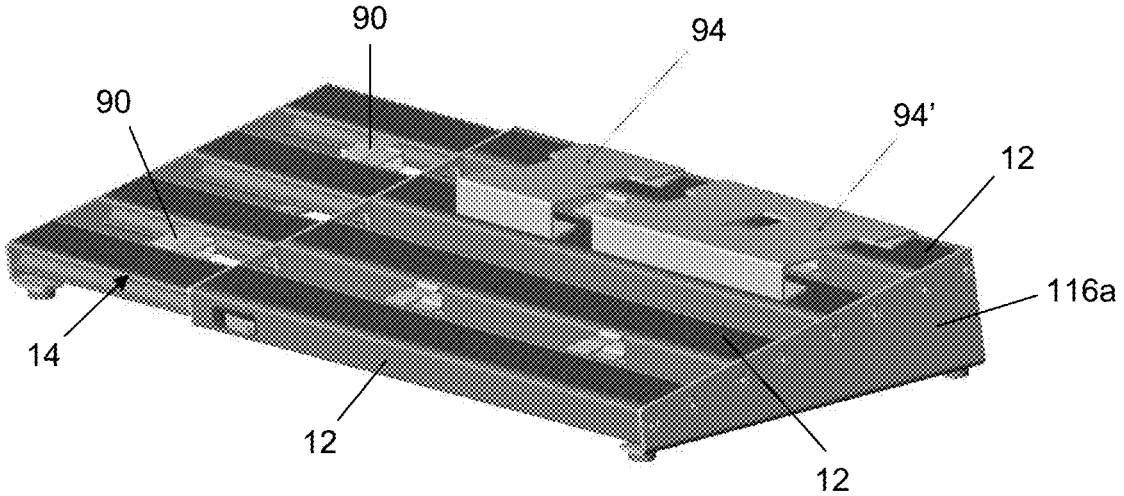
FIG. 20 is a perspective view of the pedalboard of FIGS. 18 and 19 with a pair of pedal risers installed.
Figure 21:
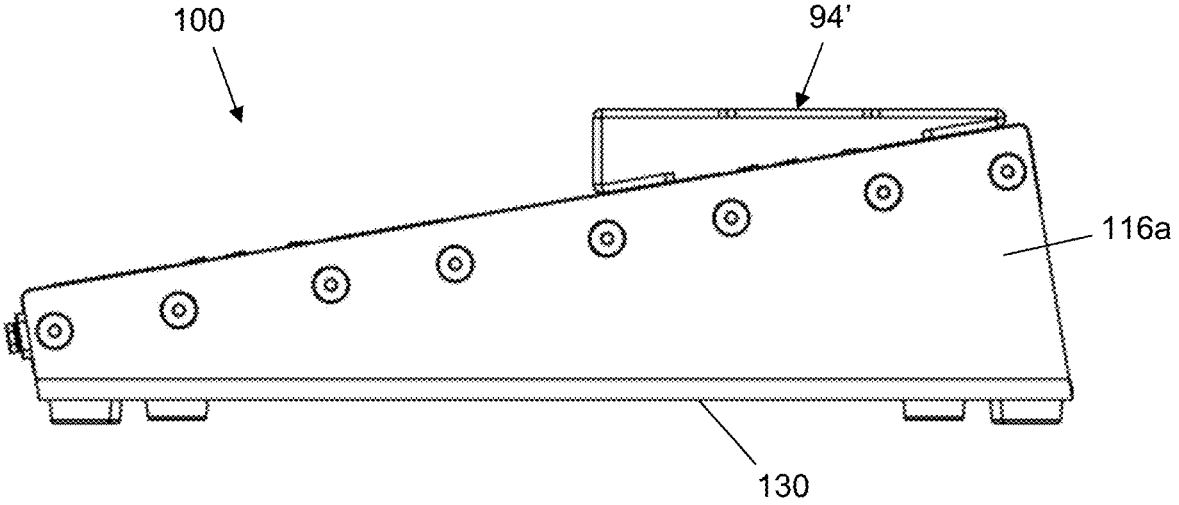
FIG. 21 is a longitudinal end view of the pedalboard of FIG. 20.

FIG. 20 depicts a pedalboard 100 with a pair of pedal riser 94' accessories installed. Typically, the bottom surfaces of the risers 94' attach to the top surface of adjacent spaced apart rails (via hook and loop or another attachment) and extend over the spacing between the respective rails to create an elevated and flat surface to mount pedals.

While not depicted here, the pedalboards may include one or more handles graspable by an individual for assisting transport. The handles may attach to the pedalboard via end plates, 16*a* or 16*b*, or directly to a rail 12 or 14. An embodiment exists wherein the handle has a releasable hinge and is collapsible or foldable to lay substantially flat against the pedalboard to provide a streamlined profile helpful when packing the board. Additionally, versions of the pedalboard exist that feature a single inner/outer rail pair, which may extend further in the front-to-rear direction than the depicted embodiments and form a solid mounting surface without spacing between the front end and rear end.

Figure 23:
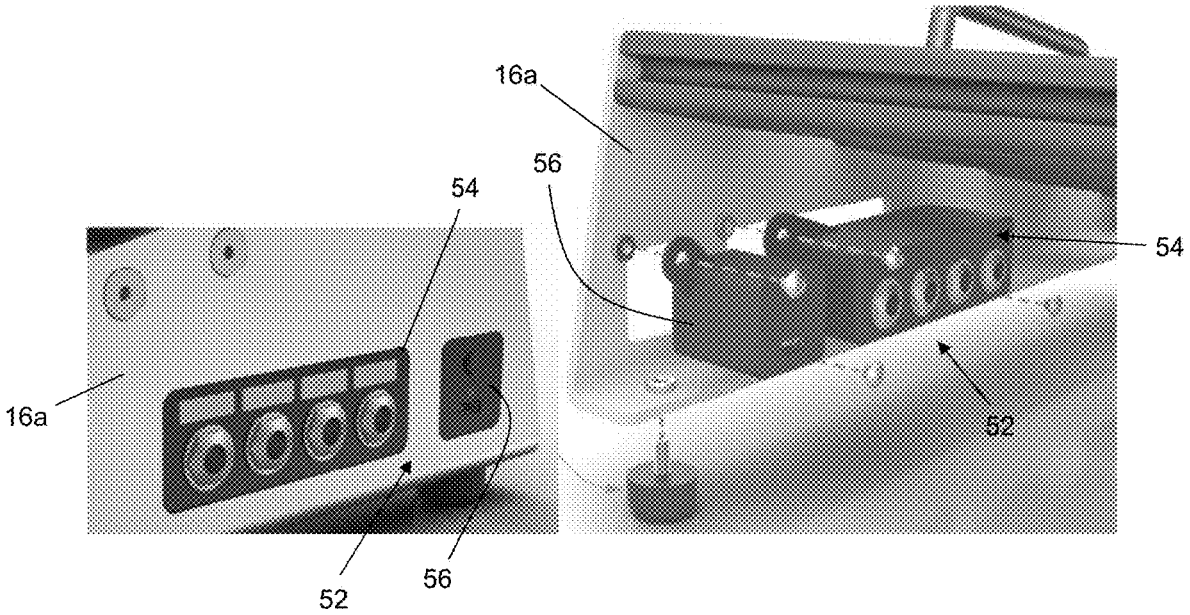
FIG. 23 shows an embodiment of the disclosed pedalboard with an integral electrical assembly.

FIG. 23 shows an exemplary electrical assembly 52 with an audio connection box 54 and electrical box 56. The audio connection box 54 has a plurality of jacks for receiving a plug of an audio cable and the electrical box 56 has electrical connections for connecting the pedalboard to a power supply, as known in the art.

Figure 25:
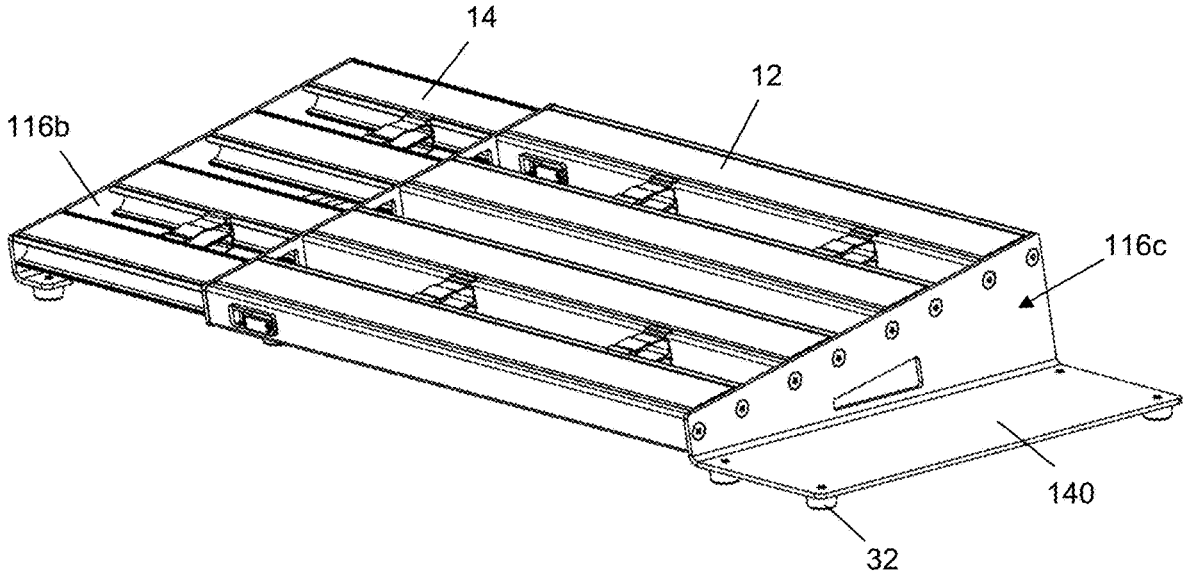
FIG. 25 depicts a pedalboard with an alternate end plate configured to mount a wah pedal.

FIG. 25 shows an alternate end plate 116*c* employed within a pedalboard. As shown, the end plate 116*c* includes a bend transitioning to an extension platform 140 located on the external side of the outer rails 14, rather than underneath the rails like the end plate 116*a* in FIG. 7. The platform 140 in the end plate 116*c* is generally sized and shaped to receive and mount a larger accessory, such as a wah pedal.

Preferred materials for the elements described herein include all rigid and durable materials, such as metals and resilient polymers. A particularly preferred embodiment includes inner and outer rails formed from extruded aluminium and end plates also formed from aluminium. Preferred dimensions of embodiments of the pedalboard and individual elements are provided in FIGS. 12-14, 16 and 18.

The disclosed embodiments of the adjustable pedalboard, 10, 100 and 200, comprising cooperative tubular rail members with substantially flat top mounting surfaces in a substantially parallel and spaced apart configuration provides musicians with a unique combination of adjustability, stability and organization that has shown to be a dramatic improvement upon existing pedalboards. While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A board for mounting musical instrument pedals, comprising:

a first elongate outer rail and a second elongate outer rail, each of the first and second outer rails having a tubular configuration, extending longitudinally, defining a longitudinal inner track and having a top mounting surface;

a first inner rail extending longitudinally and being received within the inner track of the first outer rail and a second inner rail extending longitudinally and being received within the track of the second outer rail, each of the first and second inner rails defining a top mounting surface, wherein each inner rail is longitudinally slidable within the inner central track of the respective outer rail to allow adjustment of the longitudinal length of the board between a fully extended position and a fully retracted position, and the top mounting surface of the outer rail and the top mounting surface of the inner rail are configured for attachment to a musical instrument pedal.

2. The board of claim 1, wherein the first inner rail and first outer rail extends longitudinally substantially parallel to the second inner rail and second outer rail, and the first inner rail and first outer rail are spaced from the second inner rail and second outer rail, defining a passthrough opening therebetween.

3. The board of claim 1, comprising a releasable locking member configured for locking the longitudinal length of the board in any intermediate position between the fully retracted position and the fully extended position.

4. The board of claim 3, wherein the releasable locking member is mechanically fixed and rotatable about an axis relative to the first outer rail, and comprises a lever extending from a cam through which the axis extends.

5. The board of claim 1, comprising a pair of longitudinally opposite end plates, one end plate being rigidly attached to the first and second outer rails and the other end plate being rigidly attached to the first and second inner rails.

6. The board of claim 5, wherein the end plates opposite maintain the board in an inclined position.

7. The board of claim 1, wherein each of the first and second inner rails comprises a front side with a longitudinally extending groove and a rear side with a longitudinally extending groove, and each of the first and second outer rails comprises a front side with an inwardly extending guide projection received within an inner rail front side groove and a rear side with an inwardly extending guide projection received within an inner rail rear side groove.

8. The board of claim 7, wherein the guide projections extend longitudinally along the extent of the respective front side and respective rear side.

9. A board for mounting musical instrument pedals, comprising:

a first elongate outer rail and a second elongate outer rail, each of the first and second outer rail extending longitudinally and having a top mounting surface;

a first inner rail extending longitudinally and being engaged with the first outer rail and a second inner rail extending longitudinally and being engaged with the second outer rail, each of the first and second inner rails defining a top mounting surface, wherein the first inner rail and second inner rail are longitudinally slidable relative to the first outer rail and second outer rail, respectively, to allow adjustment of the longitudinal length of the board between a fully extended position and a fully retracted position, the top mounting surface of each of the outer rails and the top mounting surface of each of the inner rails is configured for attachment to a musical instrument pedal, and the first inner rail and first outer rail extends longitudinally substantially parallel to the second inner rail and second outer rail, and the first inner rail and first outer rail are spaced from the second inner rail and second outer rail, defining a passthrough opening therebetween.

10. The board of claim 1, comprising a rigidly secured handle graspable by an individual.

11. The board of claim 1, comprising an electrical assembly having connections for a power supply and audio plugs.

12. The board of claim 1, wherein the top mounting surfaces of the outer rails and the top mounting surfaces of the inner rails each defines a longitudinal slot.

13. A board for mounting musical instrument pedals, comprising a first inner rail-outer rail pair, wherein the outer rail has a tubular shape defining a hollow track and the inner rail is slidably received within the hollow track with the outer rail circumscribing the inner rail and wherein each of the inner rail and outer rail is configured to fixably attach to a musical effects pedal.

14. The board of claim 13, wherein the inner rail is slidable between a fully retracted position defining a minimum longitudinal length of the pedalboard and a fully extended position defining a maximum longitudinal length of the pedal board, and longitudinally fixable at a plurality of different positions between the fully retracted position and fully expanded position.

15. The board of claim 13, wherein the outer rail has a substantially rectangular prismic shape with a flat top side spaced from a flat bottom side via a flat front side spaced from a flat rear side, and at least one of the front side and rear side includes an inwardly extending guide extending along its entire longitudinal extent, the guide aligning the outer rail relative to the inner rail.

16. The board of claim 15, comprising an inwardly extending guide in both of the front side and rear side of the outer rail, wherein the inner rail has a front side with a longitudinally extending groove within which the guide of the outer rail front side extends, and has a rear side with a longitudinally extending groove within which the guide of the outer rail rear side extends.

17. The board of claim 14, comprising an irregularly shaped cam fixed to the outer rail and movable between an unlocked position allowing the inner rail to slide freely within the hollow track and a locked position fixing the inner rail relative to the outer rail.

18. The board of claim 14, wherein the inner rail is fixable at the plurality of different positions via frictional engagement with a surface of a locking member and a surface of the inner rail.

19. The board of claim 9, comprising a third outer rail substantially identical to the first and second outer rails, and a third inner rail substantially identical to the first and second inner rails, wherein the third inner rail is slidably engaged with the third outer rail.

20. The board of claim 9, comprising a removable cable clip attached to the board and positioned within the passthrough opening between the first outer rail and the second outer rail or positioned within the passthrough opening between the first inner rail, the cable clip defining an opening configured to hold a cable.

* * * * *